US012702225B2

(12) United States Patent
Behrmann et al.

(10) Patent No.: US 12,702,225 B2
(45) Date of Patent: Aug. 11, 2026

(54) GUIDE FITTING AND FURNITURE OR HOUSEHOLD APPLIANCE ELEMENT

(71) Applicant: PAUL HETTICH GMBH & CO. KG, Kirchlengern (DE)

(72) Inventors: Gunter Behrmann, Kirchlengern (DE); Kathrin Heckel, Bissendorf (DE); Timo Szlapka, Bielefeld (DE); Waldemar Petker, Bünde (DE); Sören Klüter, Bad Oeynhausen (DE); Bernd Götting, Enger (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 63 days.

(21) Appl. No.: 18/860,237

(22) PCT Filed: Apr. 25, 2023

(86) PCT No.: PCT/EP2023/060801
§ 371 (c)(1),
(2) Date: Oct. 25, 2024

(87) PCT Pub. No.: WO2023/208929
PCT Pub. Date: Nov. 2, 2023

(65) Prior Publication Data

US 2026/0114612 A1 Apr. 30, 2026

(30) Foreign Application Priority Data

Apr. 27, 2022 (DE) ..... 10 2022 110 207.6

(51) Int. Cl.
*A47B 49/00* (2006.01)
*A47B 81/00* (2006.01)
(Continued)

(52) U.S. Cl.
CPC ..... *A47B 49/00* (2013.01); *A47B 49/004* (2013.01); *A47B 81/002* (2013.01); *A47B 95/00* (2013.01); *A47B 96/025* (2013.01)

(58) Field of Classification Search
CPC ..... A47B 49/00; A47B 49/004; A47B 81/002; A47B 95/00; A47B 96/025; A47B 49/006
See application file for complete search history.

(56) References Cited

U.S. PATENT DOCUMENTS 4,124,262 A * 11/1978 Schill ..... A47B 49/004 312/307
4,959,582 A * 9/1990 Meyer ..... A47B 49/00 312/307

(Continued)

FOREIGN PATENT DOCUMENTS

DE 202009007374 U1 9/2009
DE 102011053840 A1 3/2013

(Continued)

OTHER PUBLICATIONS

International Search Report and Written Opinion mailed Jul. 21, 2023 in related/corresponding International Application No. PCT/EP2023/060801.

(Continued)

*Primary Examiner* — Kimberley S Wright
(74) *Attorney, Agent, or Firm* — PATENT PORTFOLIO BUILDERS PLLC

(57) ABSTRACT

A guide fitting guides movement of a body part mounted for simultaneous translational and rotational movement relative to a stationary base. The fitting includes a guide cam track, a guide element guided in the track, and a linear guide with a first connecting part and a second connecting part movable relative thereto. One of the connecting parts is coupled in a stationary manner to the guide element and the other is coupled to the track by a pivot bearing. The track or the (Continued)

Figure 1:
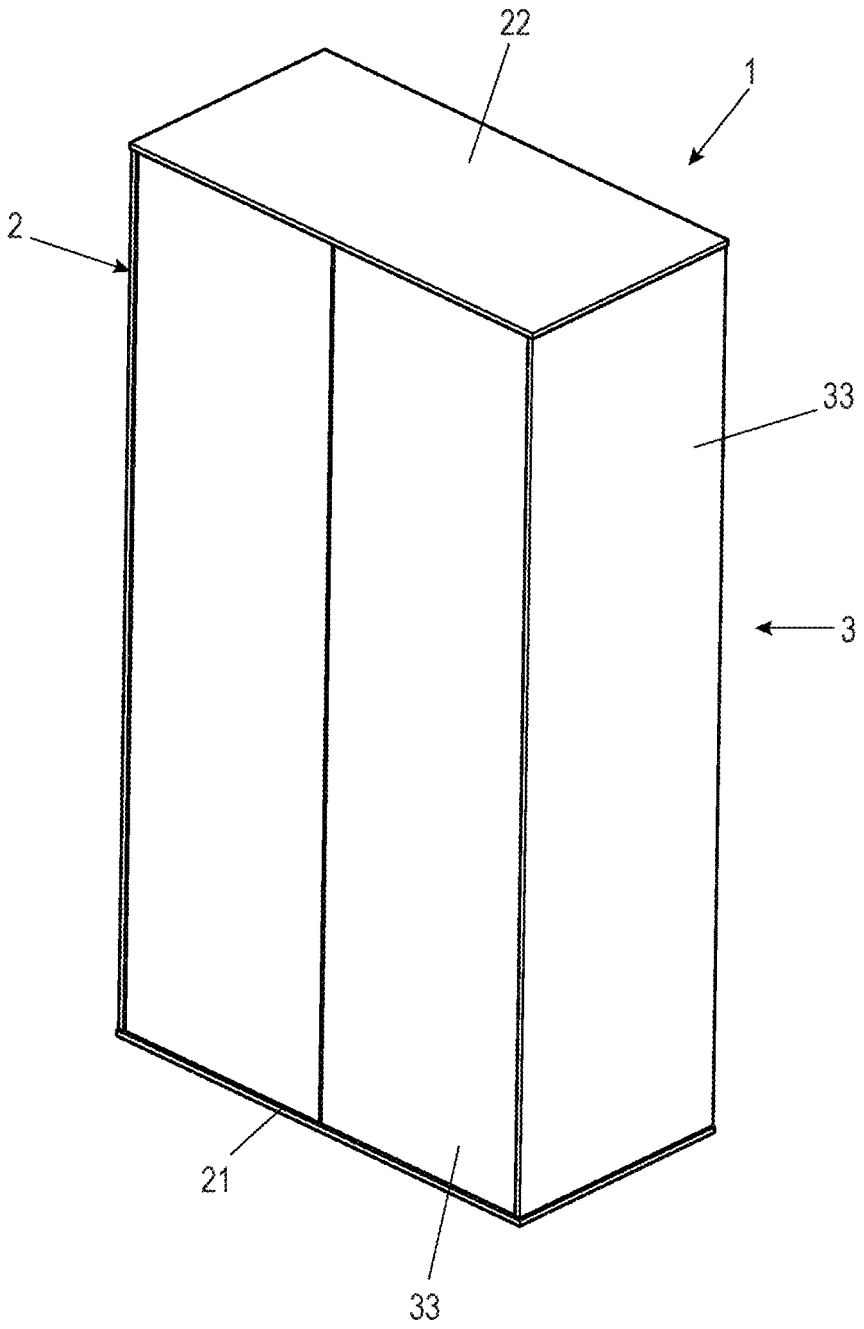

guide element is fixedly fastened to the body part. The guide cam track is moveable relative to the first connecting part from an initial position into an intermediate position in which the track is rotated relative to the first connecting part in a direction of rotation and displaced in a predetermined direction. The guide fitting has a self-closing device coupled to the guide or to the track.

18 Claims, 18 Drawing Sheets

(51) Int. Cl.
*A47B 95/00* (2006.01)
*A47B 96/02* (2006.01)

(56) References Cited

U.S. PATENT DOCUMENTS

| | | | | |
|---|---|---|---|---|
| 11,098,758 | B2 | 8/2021 | Rehage et al. | |
| 11,839,297 | B2 | 12/2023 | Rehage et al. | |
| 2018/0049545 | A1* | 2/2018 | Sagel | A47B 81/002 |
| 2022/0211176 | A1* | 7/2022 | Rehage | A47B 85/00 |
| 2022/0225763 | A1* | 7/2022 | Rehage | A47B 49/004 |
| 2024/0115040 | A1* | 4/2024 | Boekhoff | A47B 49/004 |
| 2024/0423361 | A1* | 12/2024 | Nordieker | A47B 49/004 |
| 2025/0169605 | A1* | 5/2025 | Bauerrichter | A47B 49/00 |
| 2025/0185804 | A1* | 6/2025 | Koptik | A47B 81/002 |
| 2025/0288099 | A1* | 9/2025 | Behrmann | A47B 49/004 |

FOREIGN PATENT DOCUMENTS

| | | | |
|---|---|---|---|
| DE | 102017106170 | A1 | 9/2018 |
| DE | 102019109866 | A1 | 10/2020 |
| DE | 102019132207 | A1 | 5/2021 |
| DE | 102021128965 | A1 | 5/2023 |
| EP | 2229845 | A1 | 9/2010 |
| WO | 2016173894 | A1 | 11/2016 |
| WO | 2021104832 | A1 | 6/2021 |

OTHER PUBLICATIONS

Search Report created Nov. 15, 2022 in related/corresponding DE Application No. 10 2022 110 207.6.

* cited by examiner

GUIDE FITTING AND FURNITURE OR HOUSEHOLD APPLIANCE ELEMENT

BACKGROUND AND SUMMARY OF THE INVENTION

Exemplary embodiments of the invention relate to a guide fitting for guiding a body part mounted for simultaneous translational and rotational movement, as well as to a furniture or household appliance element.

Such furniture or household appliance elements, such as shelves or racks, in which a body part mounted in a support body so that it can rotate and move in translation at the same time, are known, for example, from DE 10 2019 109 866 A1.

A translational-rotational bearing is used to perform the translational-rotational movement of the body part.

Particularly in the case of larger and/or taller furniture or household appliance elements, such as refrigerators and freezers or wine coolers, it is necessary to provide additional support for the movement of the translational-rotationally movable body part for reasons of stability.

For this purpose, it is known from DE 10 2019 132 207 A1, for example, to arrange a guide bearing between the top plates of the support body and the body part, with which the translational-rotational movement is additionally guided.

Such a furniture or household appliance element has proven itself in practice.

Particularly when the shelf is heavily loaded, an abrupt stop of the translational-rotational movement when an end position is reached can cause objects placed on the shelf to fall over and be damaged.

Depending on the strength of the impulse, impacting components of the linear guide or the guide element guided in the guide cam track can also lead to damage to these components.

Exemplary embodiments of the present invention are directed to a guide fitting and a furniture or household appliance element with which the body part can be retracted as gently as possible into a predetermined end position.

The guide fitting according to the invention for guiding the movement of a simultaneously translationally and rotationally movably mounted body part relative to a stationary base has a guide cam track and a guide element guided in the guide cam track.

The guide fitting also has a linear guide with at least a first connecting part and a second connecting part that can be moved relative to it, one of which is fixedly coupled to the guide element and the other of which is coupled to the guide cam track by means of a pivot bearing.

The guide cam track or the guide element can be fixed to the body part.

The guide cam track can be moved relative to the first connection part from an initial position to an intermediate position and further to an opening position and back. In an intermediate position, the guide cam track is rotated relative to the first connecting part in a direction of rotation and displaced in a predetermined direction. In this case, the starting position and the opening position each represent an end position.

The guide fitting is characterized by at least one self-closing device coupled at least in sections to the linear guide or to the guide cam track.

With a guide fitting designed in this way, it is possible to gently reach a respective end position of the body part.

The self-closing device also ensures that the body section is moved to a defined end position and does not come to a standstill shortly before reaching the end position.

According to an advantageous design variant, the guide cam track has a guide groove that accommodates the guide element.

This ensures reliable guidance of the body part, in particular the rotational part of the movement, in a simple manner.

According to a further advantageous embodiment, the guide fitting has a support plate to which the first connecting part of the linear guide and the guide element are attached.

The provision of such a support plate makes it easy to fit the guide fitting to the base or the body section.

According to a first preferred embodiment of the guide fitting, the at least one self-closing device is arranged in a fixed position relative to the guide cam track or one of the connecting parts of the linear guide.

Since the guide cam track and the linear guide ensure the intended translational-rotational movement of the body part, the arrangement of the at least one self-closing device on the component responsible for the rotational part or the translational part of the movement at a suitable point on the component represents a preferred attachment point on the guide fitting.

A first embodiment of such a self-closing device has a housing with a guide track and a catching element that is spring-loaded and/or damped in the guide track and catches the guide element in a predetermined position.

The guide track can, for example, be designed as a so-called crusher cam, with which the catching element can be moved into a position in which the guide element is released from the catching element and the catching element picks up the guide element and guides it spring-loaded and/or damped into the end position by subsequent impact at a suitable point on the catching element.

According to a preferred embodiment of the guide fitting, one such self-closing device is arranged at each end of the guide cam track at a distance from one another.

In an alternative embodiment of the guide fitting, the support plate has a central area to which two first connecting parts of the linear guide, aligned parallel to each other, are attached and two edge areas to each of which a self-closing device is attached.

The guide cam track has an arm extending outside the guide groove, on which two activators interacting with the self-closing device are arranged, in particular molded on.

According to yet another alternative embodiment of a guide fitting according to the invention, the self-closing device is coupled to the second connecting part of the at least one linear guide.

According to a preferred further development, the self-closing device is designed here in such a way that it has a toggle lever pivotably mounted on the support plate with a first lever pivotably attached to the second connecting part and a second lever pivotably coupled to the first lever and pivotably attached to the support plate.

In an alternative embodiment, the second lever is pivotably attached to the second connecting part of the linear guide and pivotably coupled to the first lever, which is pivotably attached to the support plate in this case.

The guide fitting also has at least one force accumulator coupled to the first lever or the second lever.

The force accumulator is preferably held directly or indirectly on the support plate or on the second connection part of the at least one linear guide.

A self-closing device designed in this way also makes it easy for the body part to be pulled into the respective end position by itself. In this embodiment, only one such self-closing device is necessary, in particular since the second connecting part assumes the same position in each end position of the body part.

According to a preferred further development, at least one damping element is arranged between the support plate and the first lever or the second lever.

This makes it easy to dampen the deceleration of the body section before it reaches its end position.

In yet another embodiment, the guide fitting also has an ejector device.

The furniture or household appliance element according to the invention, in particular a shelf or rack with at least one storage level, has a stationary body and a body part with at least one storage surface which is mounted so as to be movable in translation and rotation relative to the body.

Furthermore, the furniture or household appliance element has at least one guide fitting for enabling a translational-rotational movement of the body part relative to a support plate of the body from an initial position into an intermediate position and further into an opening position and back.

In an intermediate position, the body part is rotated relative to the support plate in a direction of rotation and displaced in a predetermined direction of translation.

The guide fitting has at least one guide cam track and a guide element guided in the guide cam track, which are arranged on facing surfaces of the body part and the support plate.

The guide fitting also has at least one linear guide with a first connecting part and a second connecting part that can be displaced relative to it, one of which is fixedly coupled to the guide element and the other of which is coupled to the guide cam track by means of a pivot bearing.

The furniture or household appliance element is characterized by at least one self-closing device coupled at least in sections to the linear guide or to the guide cam track and arranged between the body part and the support plate.

In a preferred embodiment, the guide cam track is fixed to the base plate or the top plate of the body part and the guide element is fixed to the base support plate or the top support plate of the support body.

According to a further preferred embodiment, a first guide fitting is arranged between the base support plate and the base plate and a second guide fitting is arranged between the top support plate and the top plate of the body part.

In a further preferred embodiment, the body part can be moved relative to the support body from a first functional position into a second functional position rotated by a predetermined angle relative to the starting position, wherein in both functional positions the base (support) plates and the top (support) plates of the body part and the support body are aligned in matching geometries relative to one another.

BRIEF DESCRIPTION OF THE DRAWING FIGURES

Figure 2:
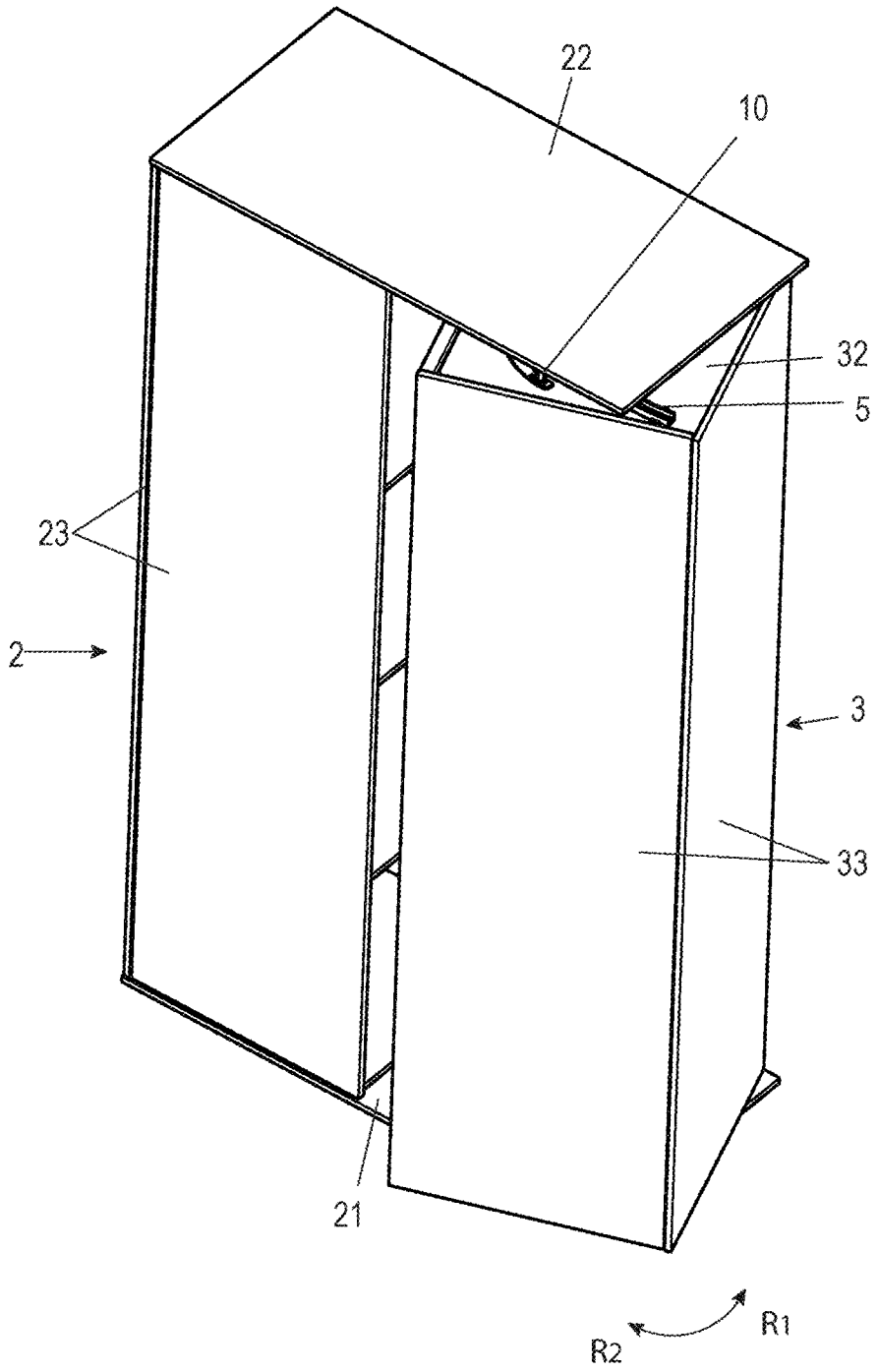
Figure 3:
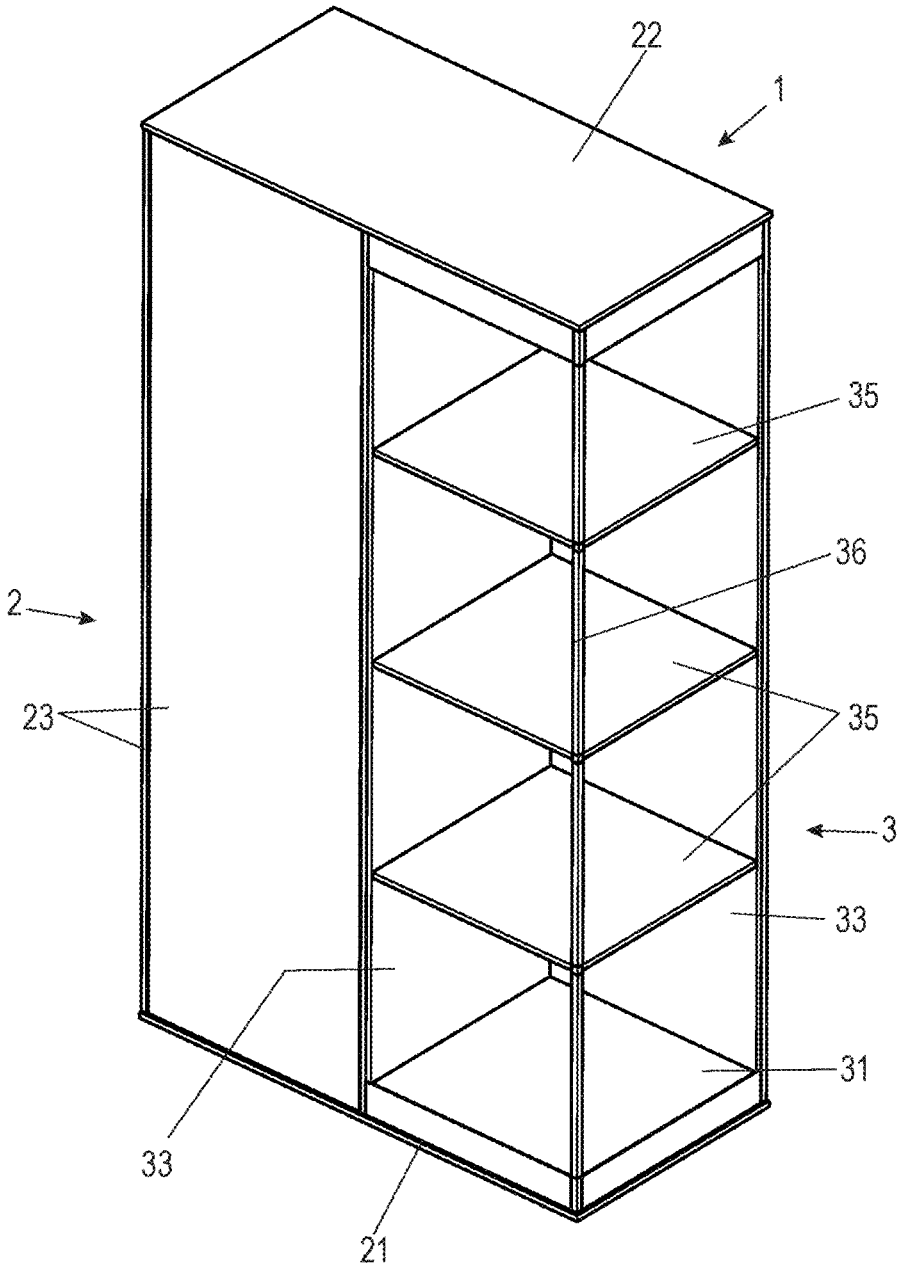
Figure 4:
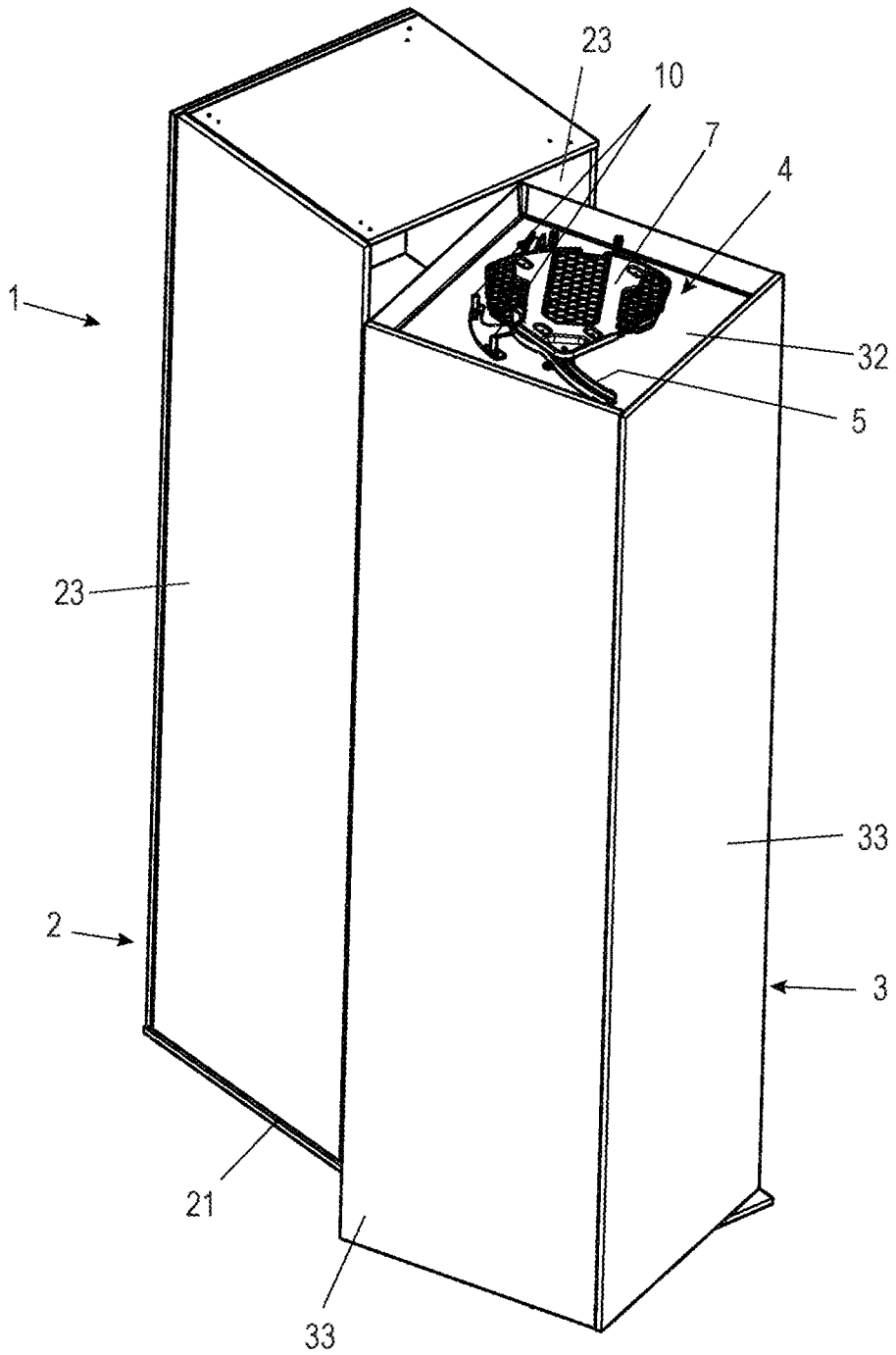
Figure 5:
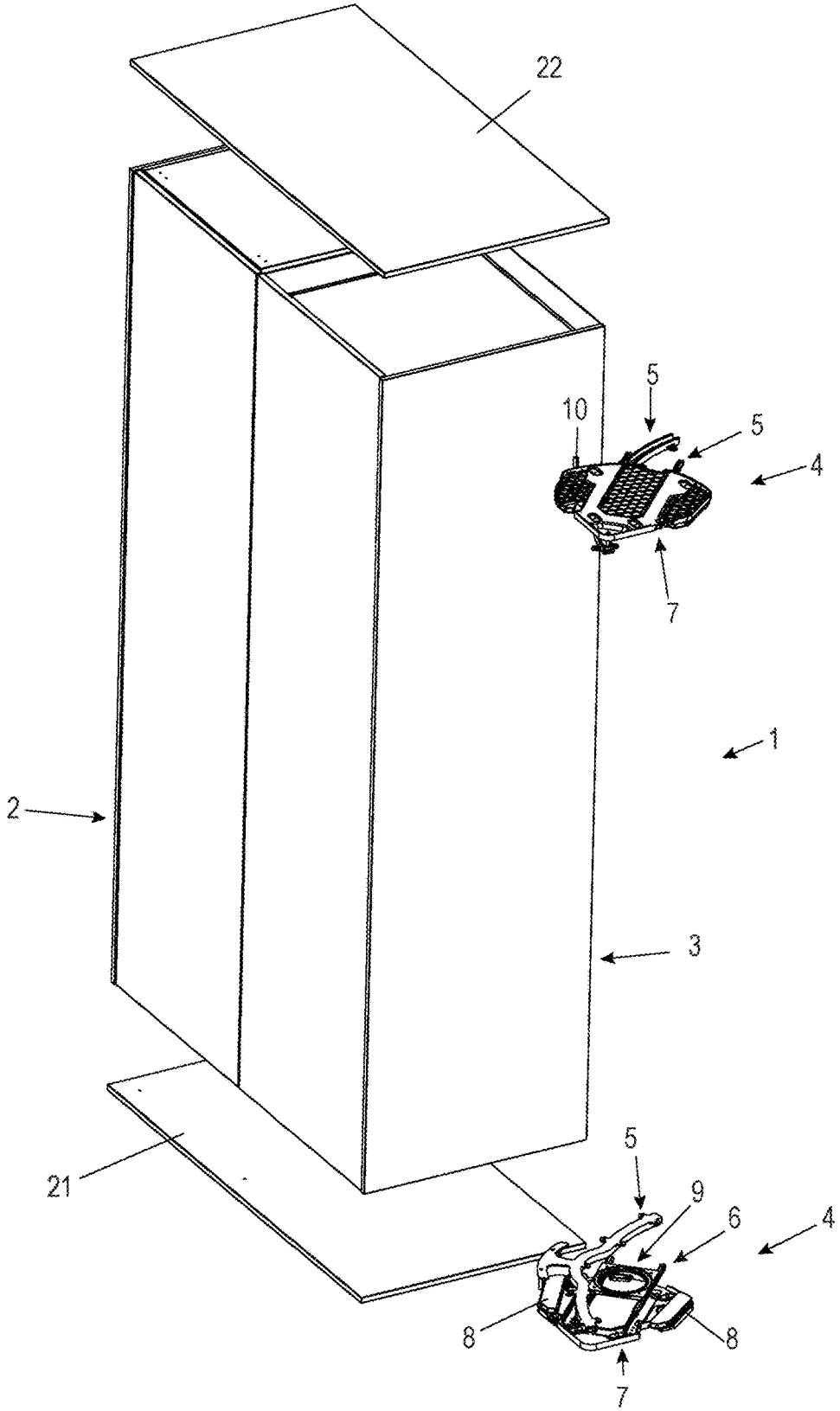
Figure 6:
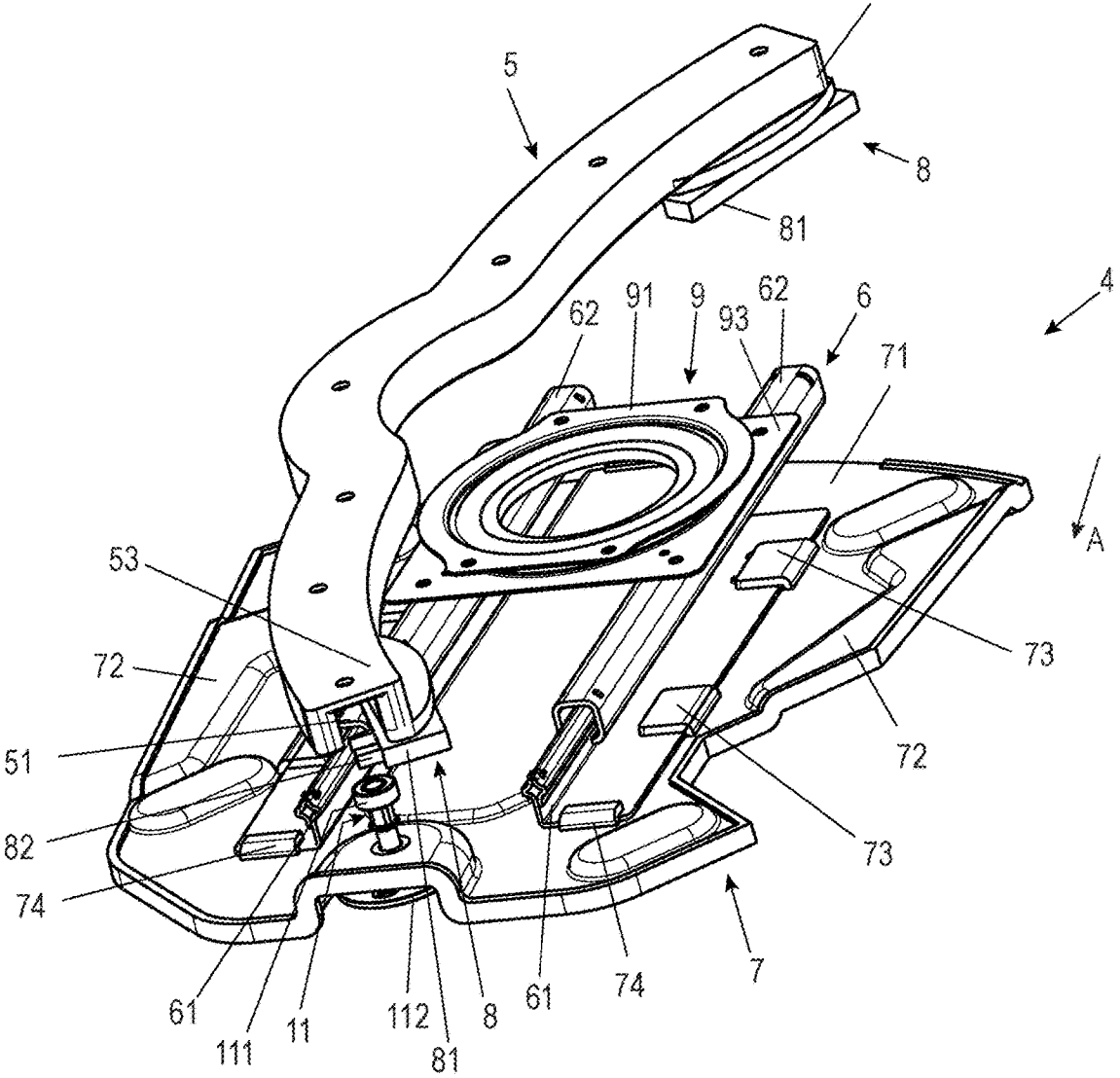
Figure 7:
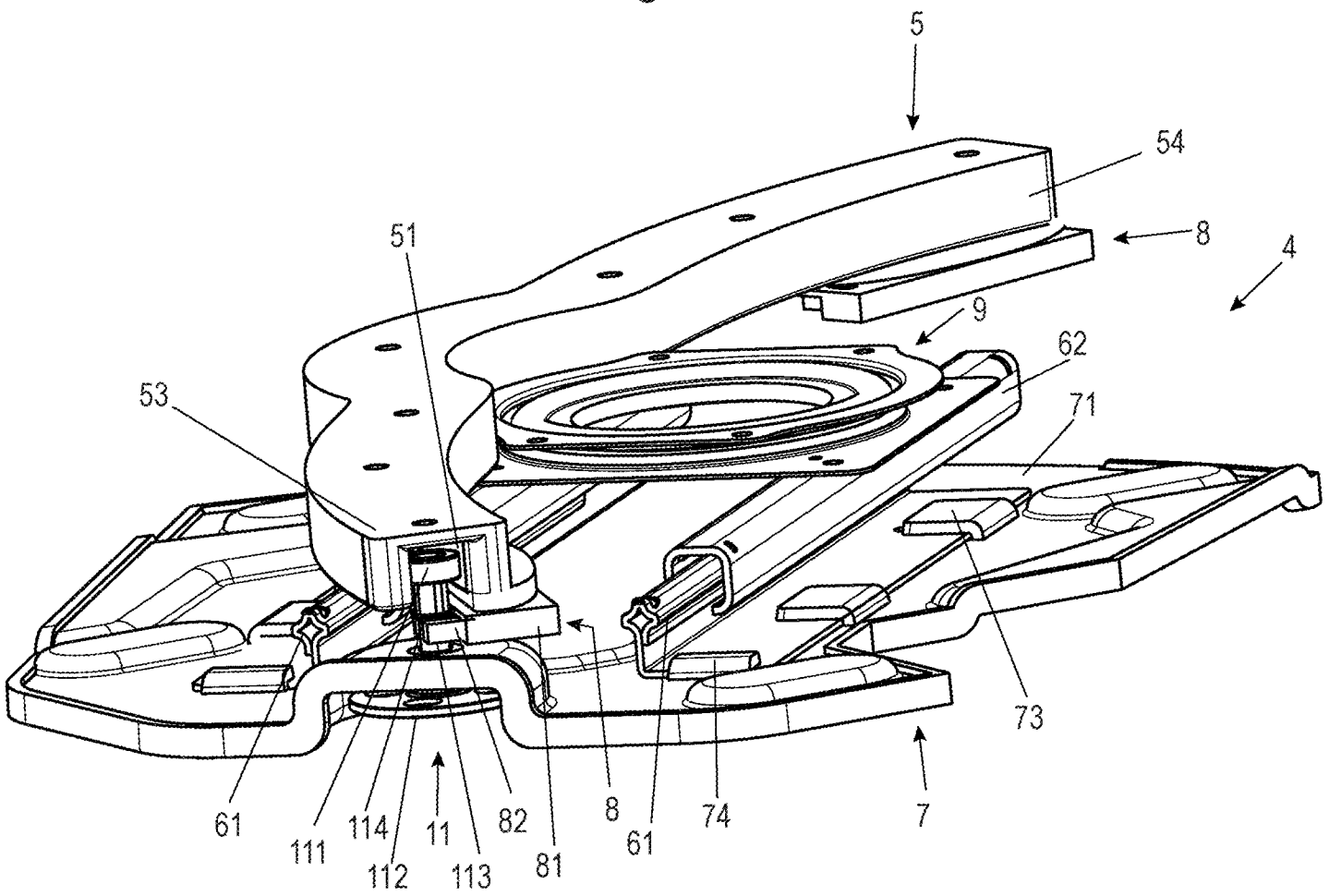
Figure 8:
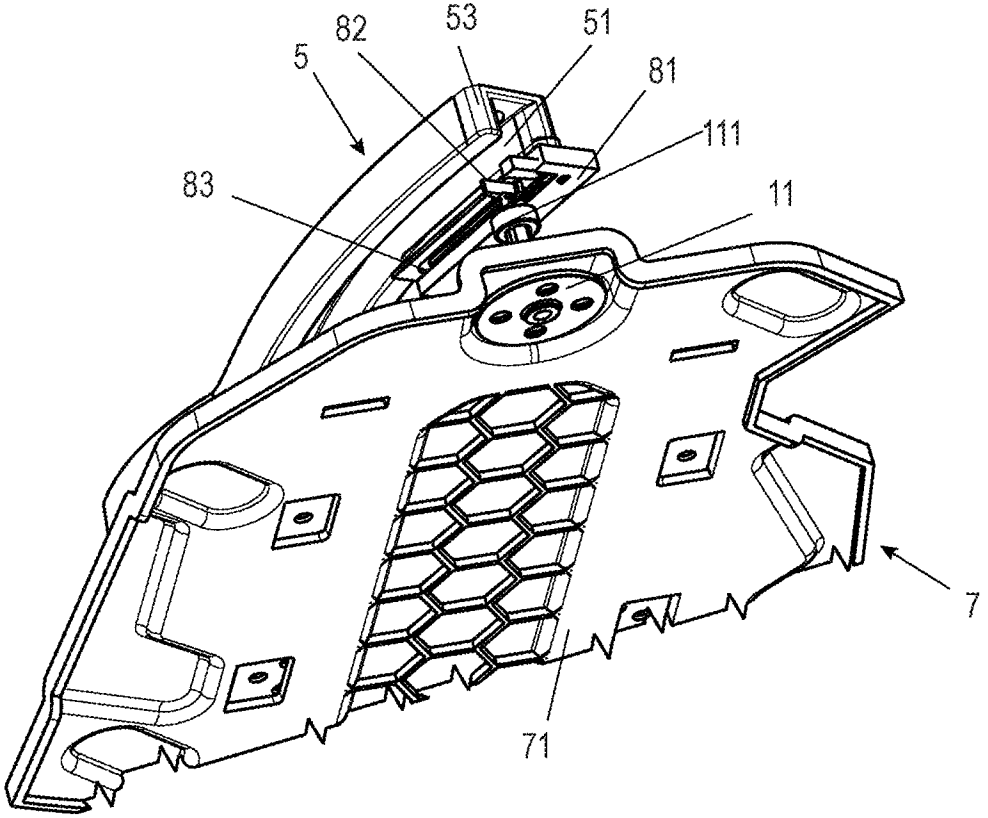
Figure 9:
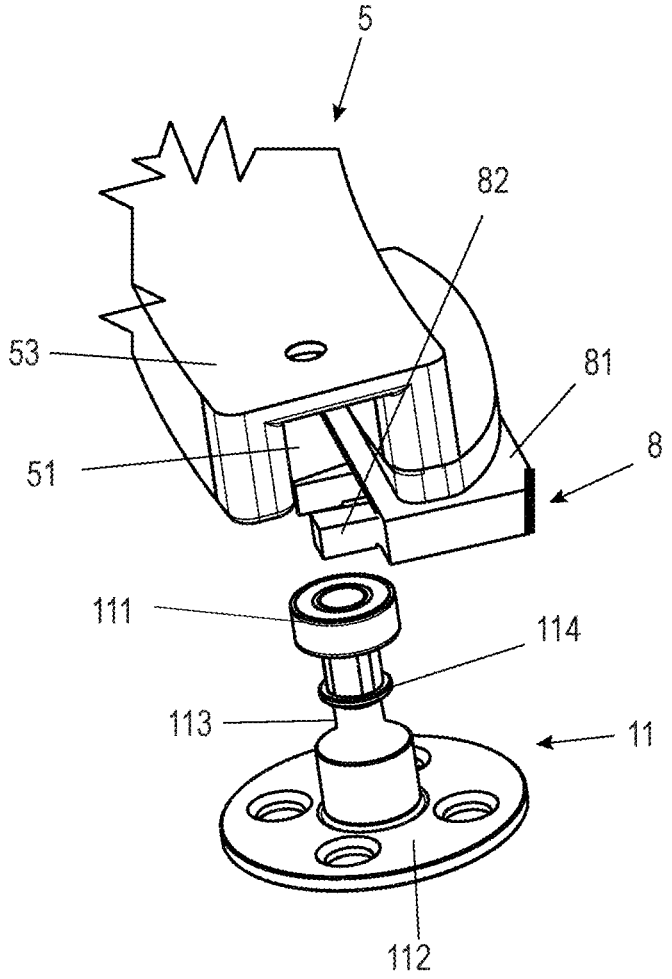
Figure 10B:
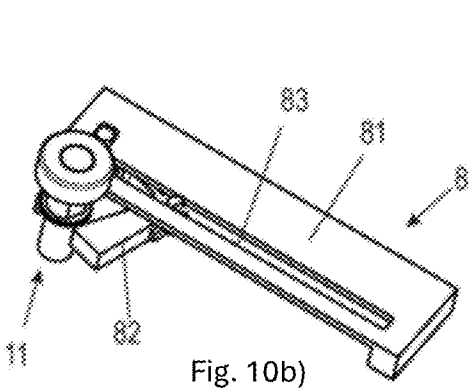
Figure 10A:
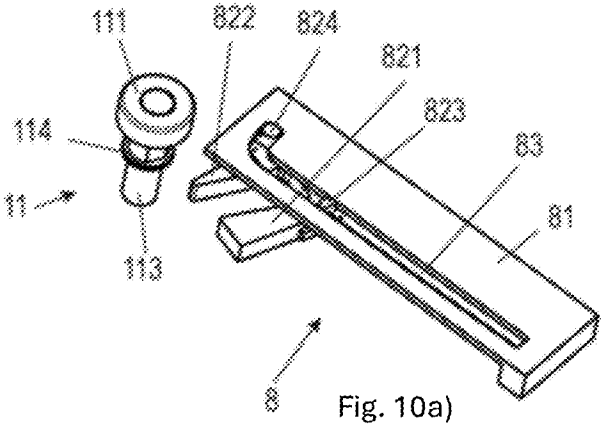
Figure 11:
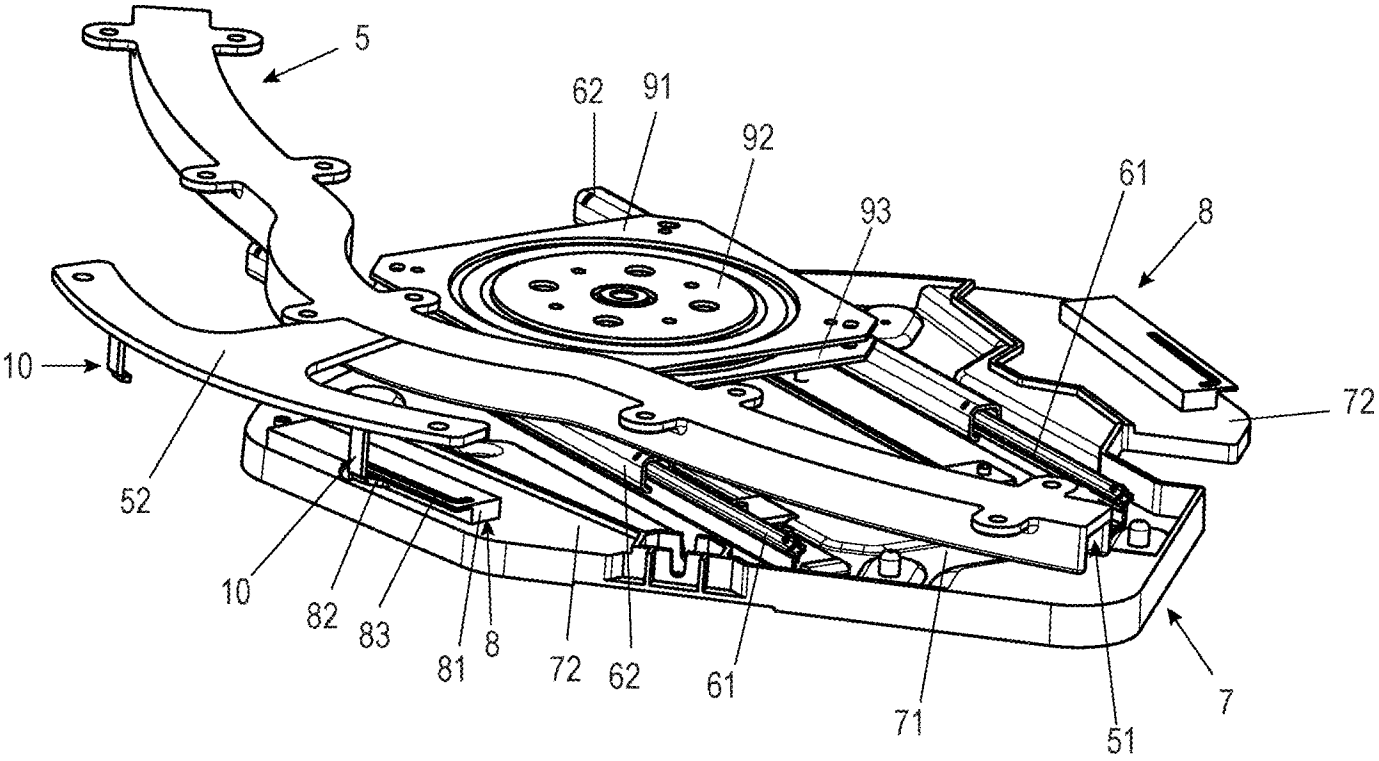
Figure 12:
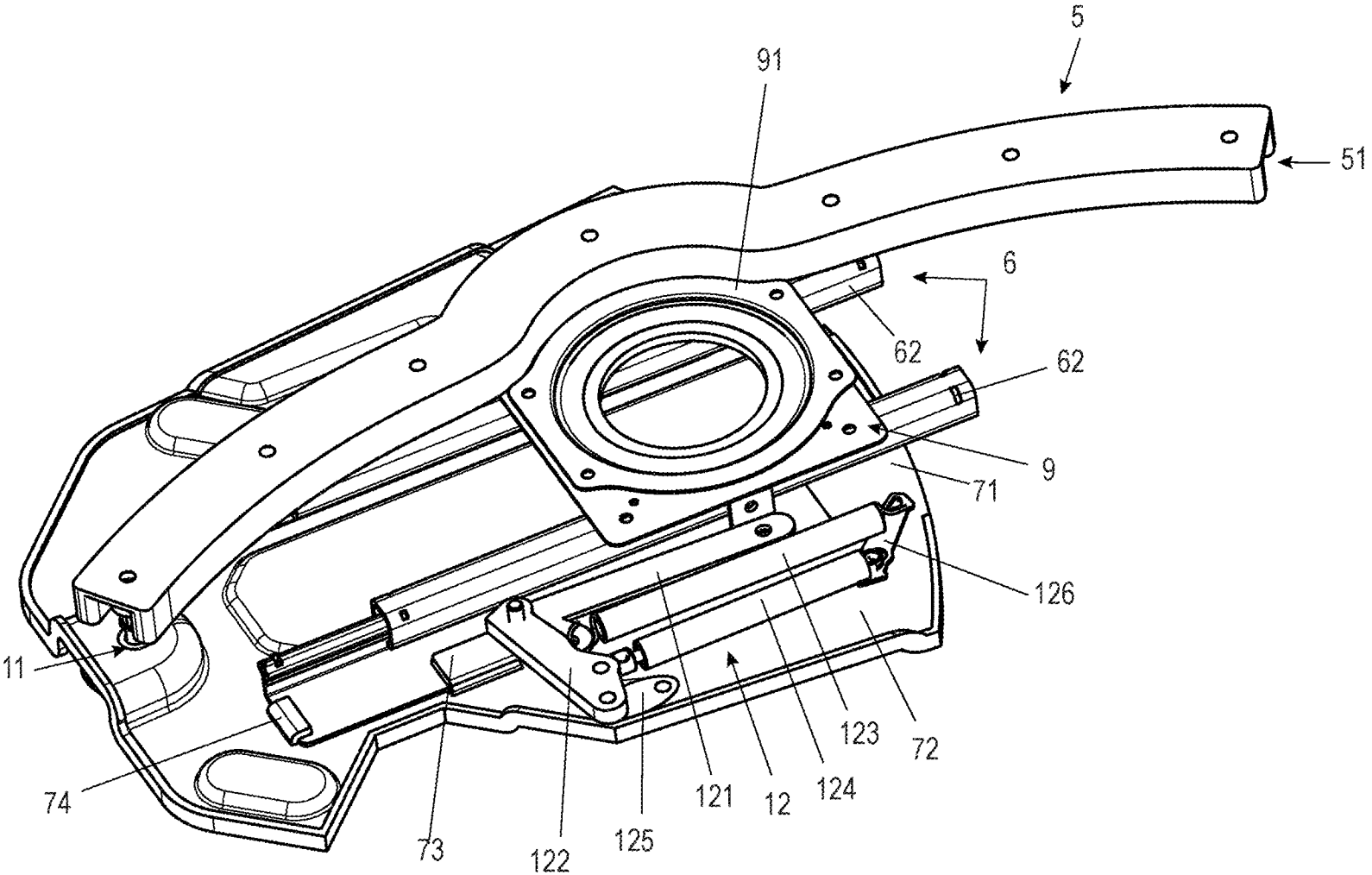
Figure 13:
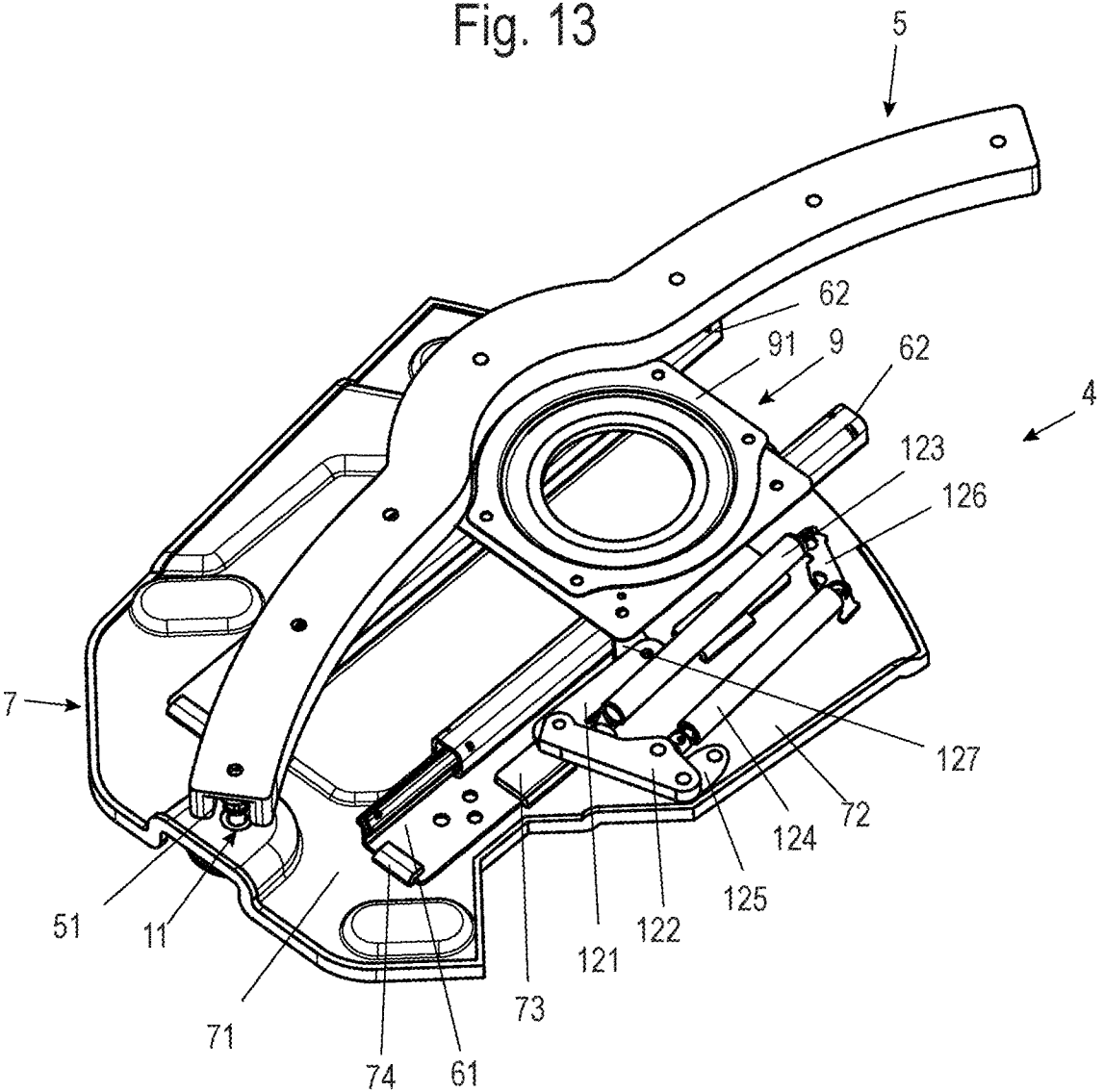
Figure 14:
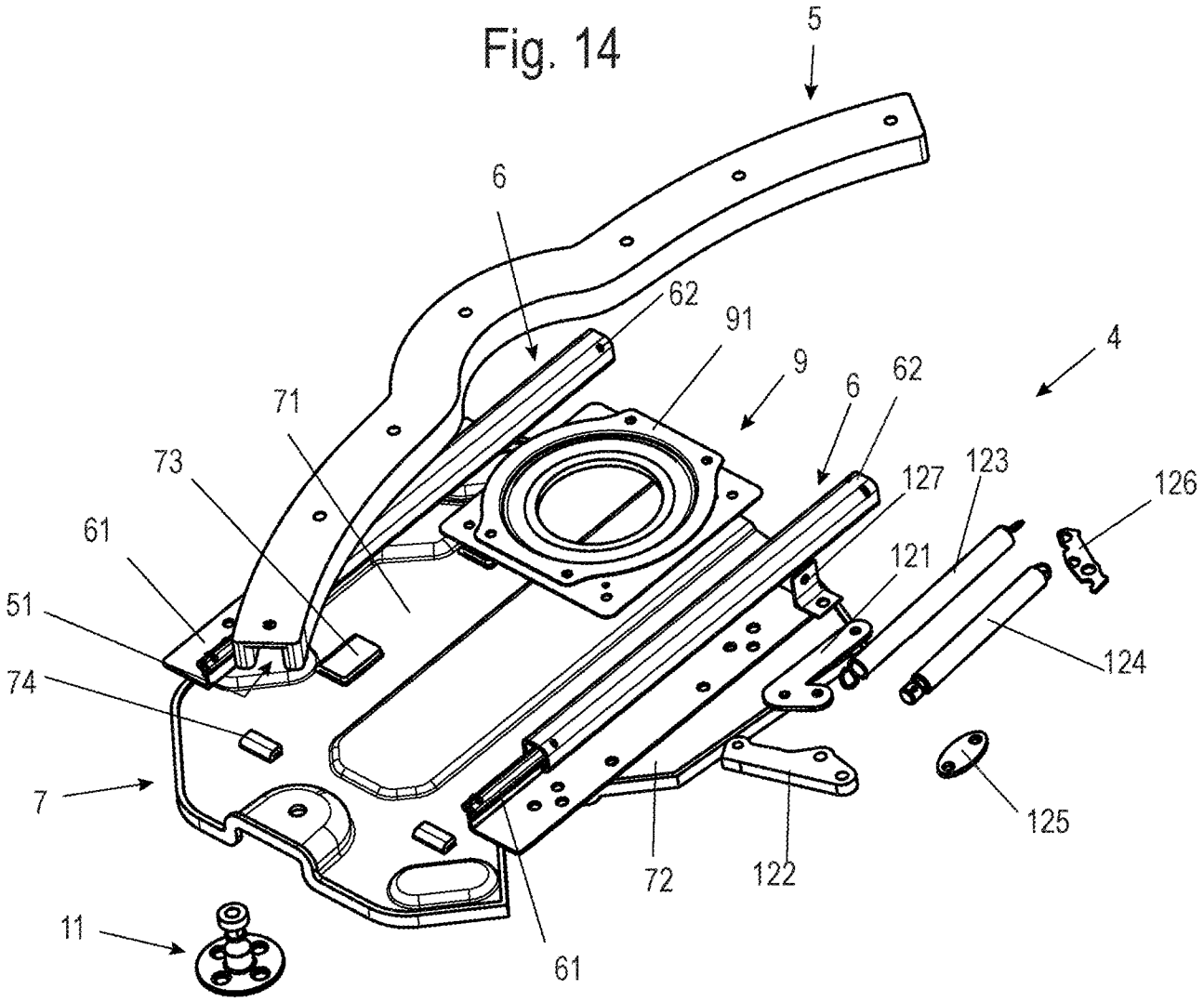
Figure 15:
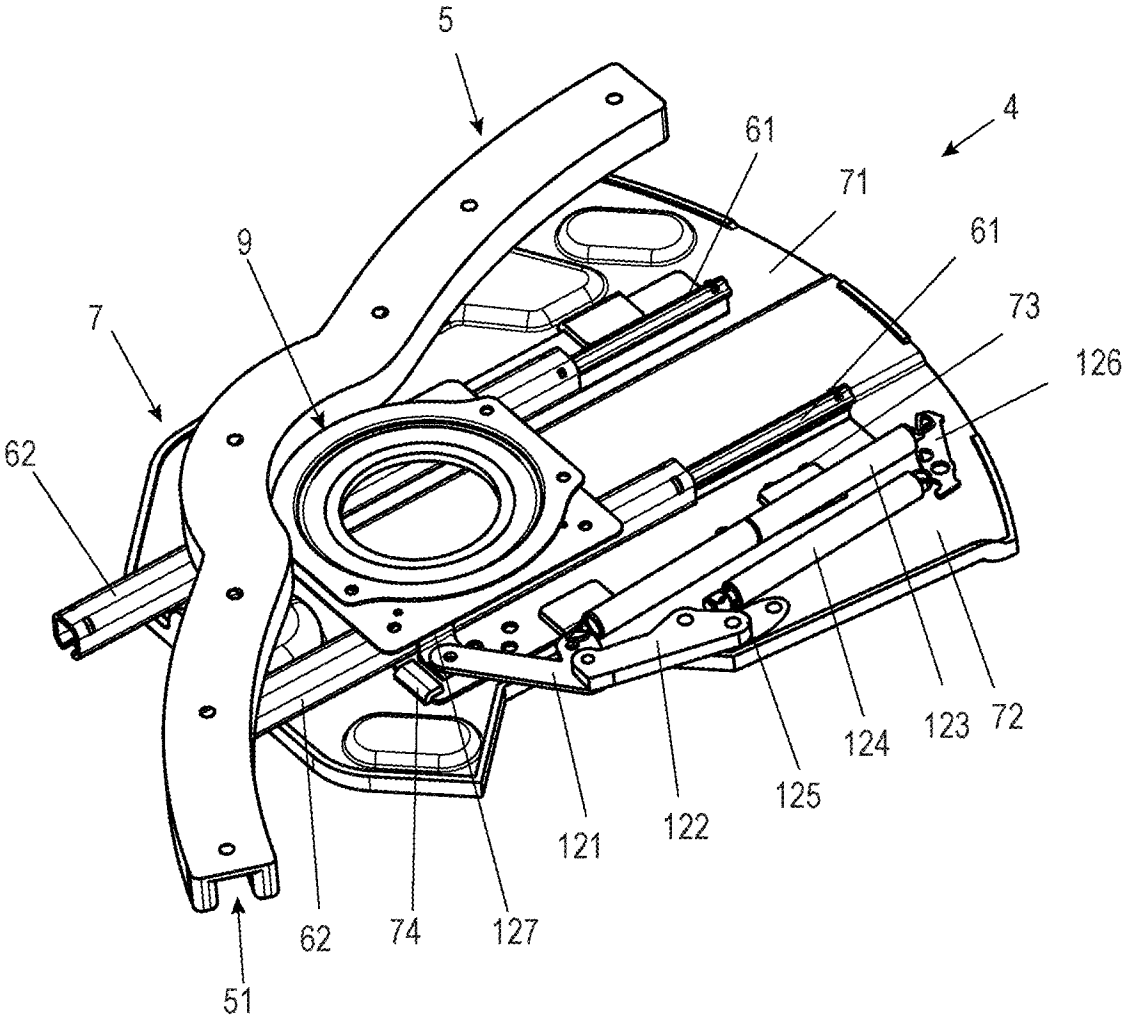
Figure 16:
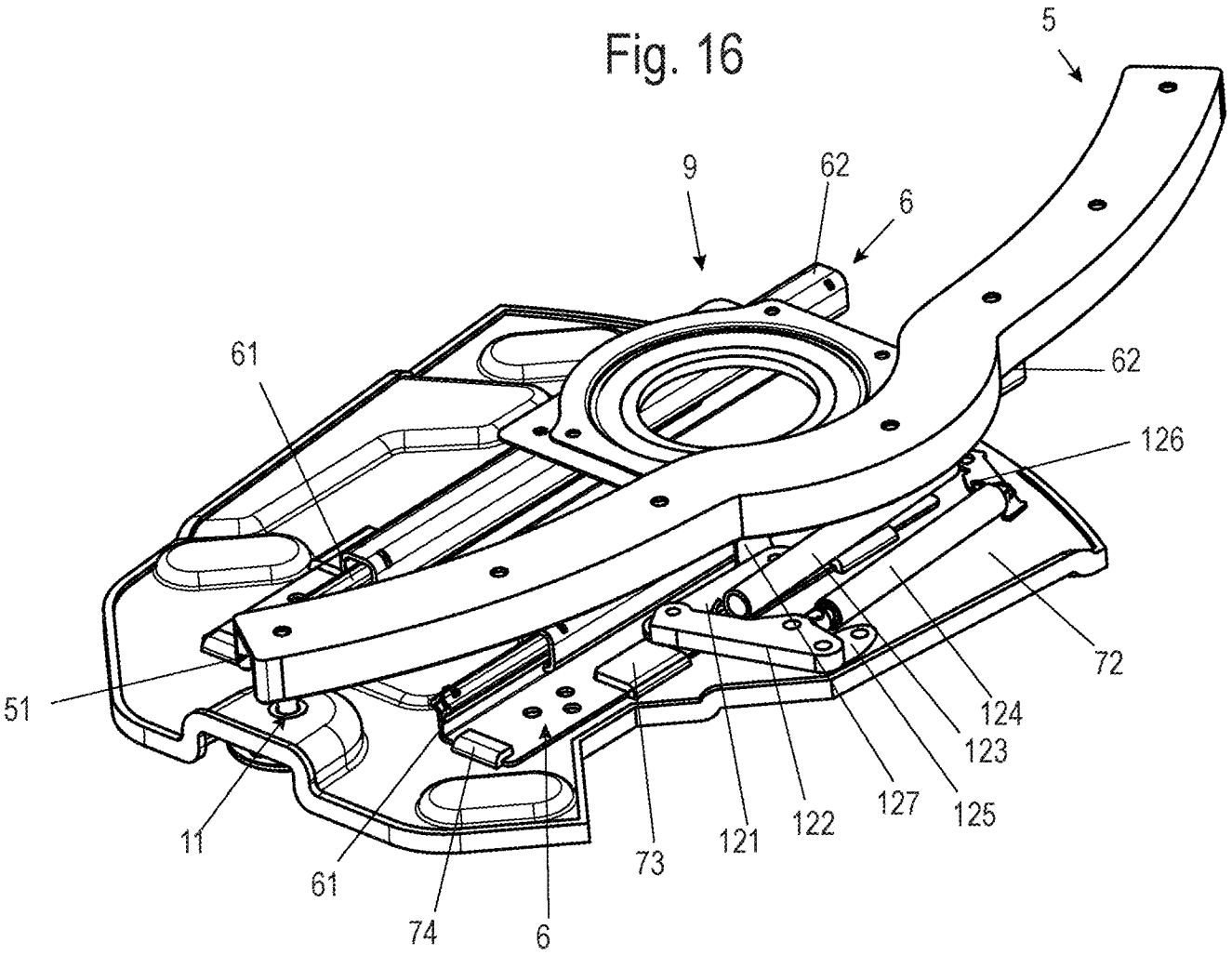
Figure 17:
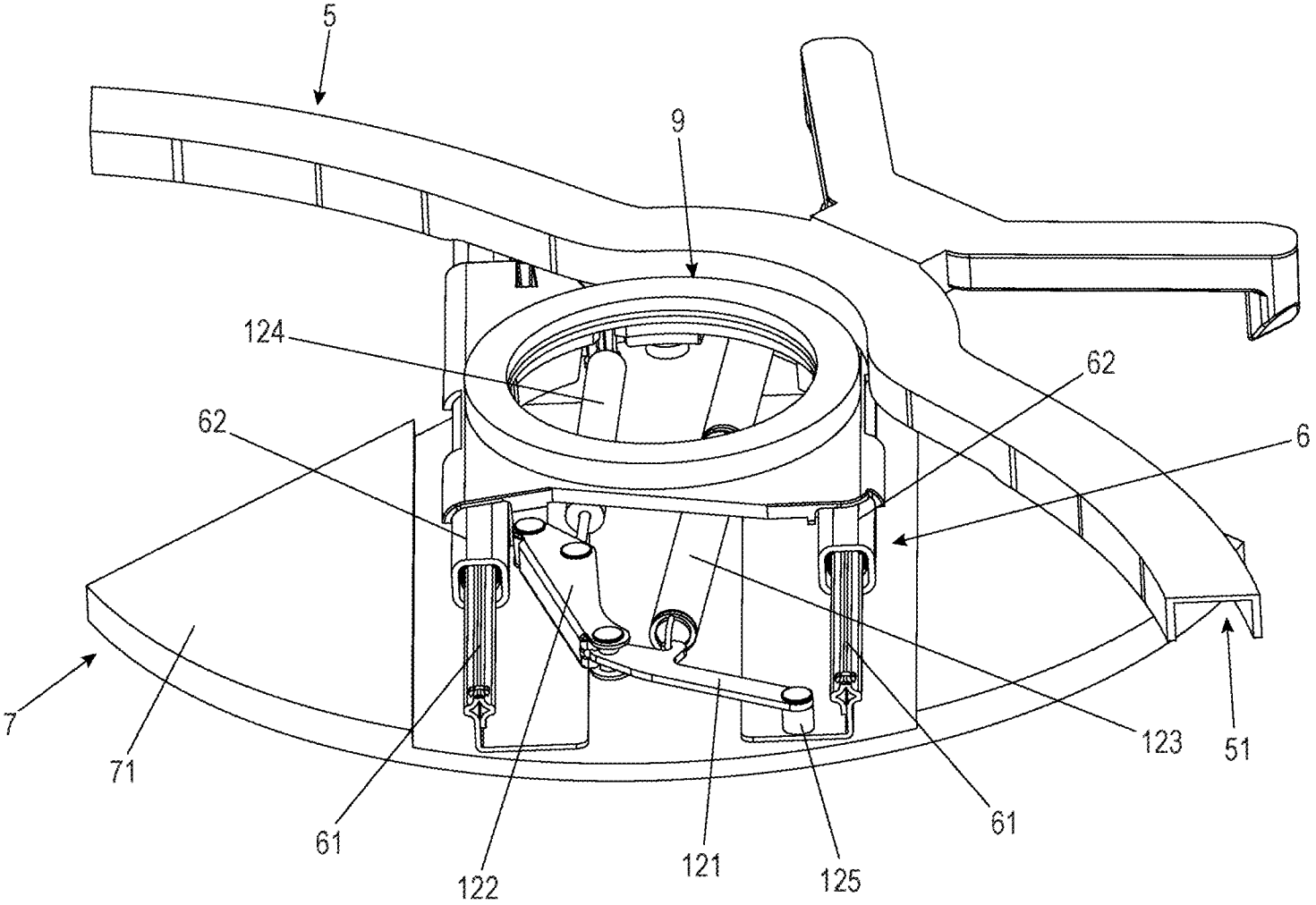
Figure 18:
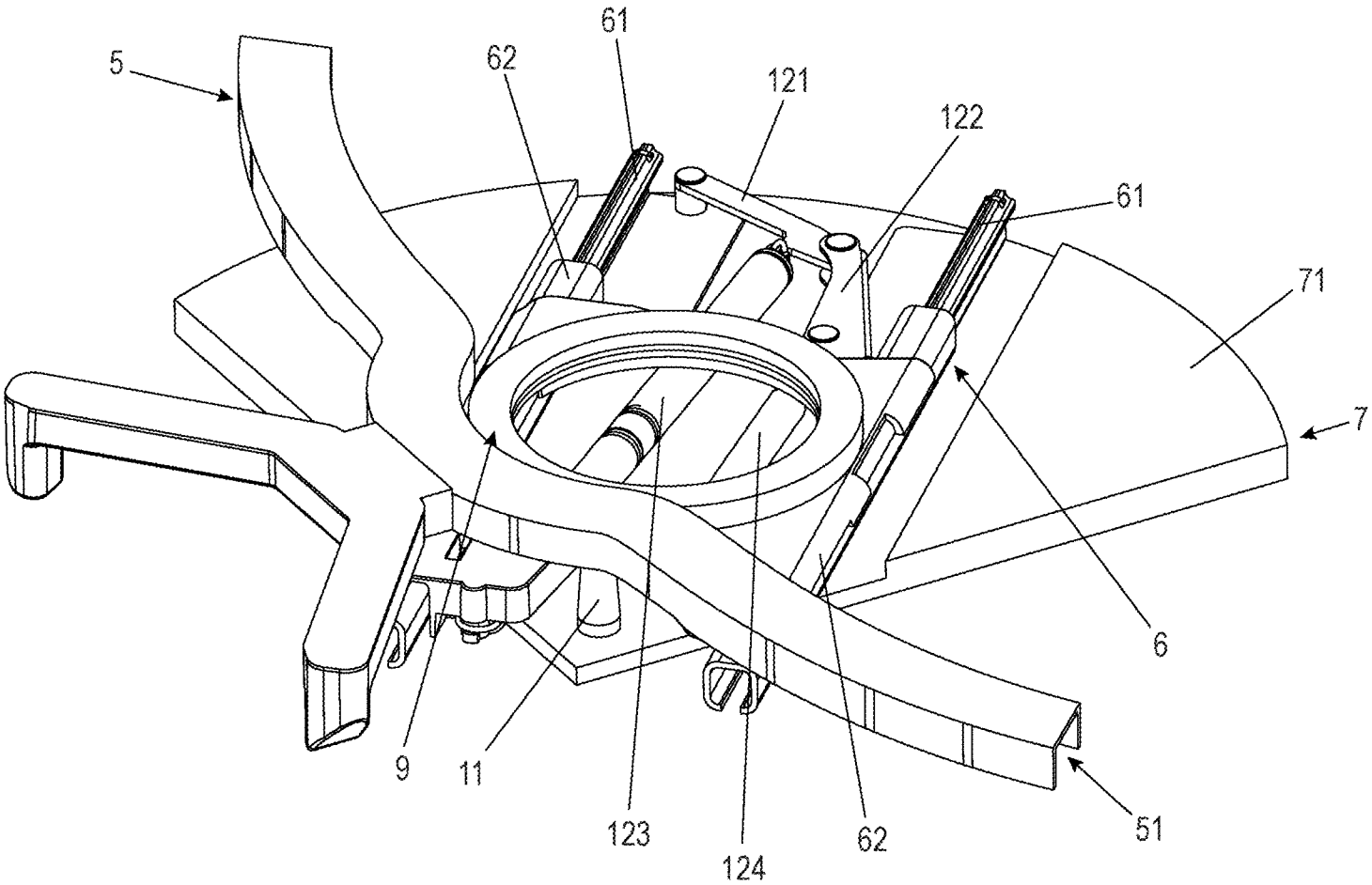

In the following, preferred embodiments of the invention are explained in more detail with reference to the accompanying drawings, wherein:

FIG. 1 shows an embodiment of a furniture element according to the invention with support body and body part, with a body part positioned in an initial position corresponding to a closed position, FIG. 2 shows an isometric view of the furniture element corresponding to FIG. 1 in an intermediate position of the body part relative to the support body, FIG. 3 shows an isometric view of the furniture element corresponding to FIG. 1 in an end position of the body part with access to shelves of the body part, FIG. 4 shows an isometric view of the furniture element corresponding to FIG. 2 with the top support plate hidden to show a guide fitting arranged between the top support plate and the top plate, FIG. 5 shows an additional isometric view of the furniture element shown in FIG. 1 in a partially exploded view with a variant of two guide fittings arranged between the base support plate and base plate and the top support plate and top plate, FIGS. 6 to 8 show isometric individual representations of a first design variant of a guide fitting with self-closing devices attached to the ends of the guide cam track, FIG. 9 shows an isometric individual representation of the guide element according to FIGS. 6 to 8 and a first end of the guide cam track and the self-closing device attached there, FIGS. 10*a*) to *d*) show isometric individual representations of the self-closing device and the guide element to illustrate the movement sequence of a self-closing device, FIG. 11 shows an isometric magnified view of the second embodiment of a guide fitting shown in FIG. 5, FIGS. 12 and 13 show isometric individual representations of a third embodiment of a guide fitting with an alternative embodiment of a self-closing device attached to one of the running rails of the linear guide, FIG. 14 shows an isometric exploded view of the guide fitting shown in FIGS. 12 and 13, FIGS. 15 and 16 show isometric representations of the guide fitting according to FIGS. 12 and 13 in different positions, and FIGS. 17 and 18 show isometric individual representations of a fourth design variant of a guide fitting with an alternative design variant of a self-closing device attached to one of the running rails of the linear guide from different perspectives.

DETAILED DESCRIPTION

In the following description of the figures, terms such as top, bottom, left, right, front, rear, etc. refer exclusively to the exemplary representation and position of the guide fitting, the furniture or household appliance element, the self-closing device, activator, guide fitting, guide cam track, linear guide and the like selected in the respective figures. These terms are not to be understood restrictively, i.e. these references may change due to different working positions or the mirror-symmetrical design or the like.

In FIGS. 1-5, the reference sign 1 is used to designate a variant of a furniture element according to the invention.

The furniture element 1 shown here essentially consists of a support body 2 with a base support plate 21, a top support plate 22, and side walls 23 connecting the base support plate 21 to the top support plate 22 as well as a body part 3 which can be moved relative to the support body 2 simultaneously in translation in a direction of translation A and in rotation in one of two possible directions of rotation R1, R2.

Instead of the side wall 23 connecting the base support plate 21 to the top support plate 22, a design variant of the support body 2 without side wall 23 is also conceivable, for example when the base support plate 21 and the top support plate 22 are attached to a building wall.

The body part 3 also has a base plate 31, a top plate 32, and a connecting element connecting the base plate 31 to the top plate 32, in the embodiment example shown in the form of at least one side wall 33.

In the embodiment shown in these figures, the shelf-like body part 3 has a square base area with two side walls 33, which close an interior space in a closed position shown in FIG. 1, and two open vertical sides, shown in FIGS. 2 and 3, which allow access to the interior space.

Instead of the side walls, it is also conceivable to connect the base plate 31 to the top plate 32 via corner posts 36, shown as an example in FIG. 3, or a central post in the middle of the surface of the base plate 31 or top plate 32.

In the embodiment shown here, the interior of the body part 3 has several shelves 35. However, other configurations or subdivisions of the interior of the body part 3 are also conceivable in principle.

As further shown in FIGS. 2, 4, and 5, a guide fitting 4 is arranged between the top support plate 22 and the top plate 32, shown in FIGS. 2 and 4, and/or between the base support plate 21 and the base plate 31, shown in FIG. 5, by means of which the simultaneous translational and rotational movement of the body part 3 relative to the support body 2 is made possible.

Preferably, the body part 3 provided here with a square base can be moved relative to the support body 2 from a first functional position into a second functional position rotated by a predetermined angle relative to the starting position, wherein in both functional positions the base (support) plates 21, 31 and the top (support) plates 22, 32 of the body part 3 and of the support body 2 are aligned in matching geometries relative to one another.

It is also conceivable, for example in the case of a body part 3 with a rectangular base and unequal side lengths, that the second rotated functional position is not congruent with the first functional position. For example, after rotating such a body part, a different depth must be approached in order to also rest against a building wall or a wall of the support body.

Preferred embodiments of such a guide fitting 4 are shown in more detail in FIGS. 6 to 16.

A first embodiment of such a guide fitting 4 is shown in FIGS. 6 to 9.

The guide fitting 4 also has a linear guide 6 with at least one first connecting part, designed here as a guide rail 61, and a second connecting part, designed here as a running rail 62, which can be moved relative to the first connecting part, one of which is fixedly coupled to the guide element 11 and the other of which is coupled to the guide cam track 5 by means of a pivot bearing 9. Other variants of a linear guide can also be used, for example a guide rail with a roller carriage that can be moved on it.

In the embodiment example shown, the pivot bearing 9 fastened to the two running rails 62 comprises a first and second mounting plate 91, 93, wherein the second mounting plate 93 is fastened to the running rails 62 and the first mounting plate 91 can be fastened correspondingly to the top plate 32 or the base plate 31 of the body part 3.

In an exemplary embodiment shown in FIG. 11, a turntable 92 is also attached to the first mounting plate 91. The mounting plates 91, 93 are mounted so that they can rotate relative to one another.

The turntable 92 and the first mounting plate 91 are preferably fastened to the base plate 31 or the top plate 32 of the body part 3, just like the guide cam track 5.

Both the guide rails 61 of the linear guide 6 and the guide element 11 are fixed to a support plate 7 in the preferred design variant of the guide fitting 4 shown here.

Alternatively, the guide rails 61, the guide element 11, and/or the self-closing devices 8 can be arranged directly on the top support plate 22 and/or base support plate 21.

To fix the guide rails 61 in place, fixing elements 73, 74 are provided on the support plate 7, with which a fixing area of the guide rails 61 can be positively fixed to the support plate 7.

As shown in FIGS. 6 to 9, the guide element 11 has a wheel 111 that can be guided in the guide groove 51 of the guide cam track 5 and which is connected via a guide neck 113 to a foot 112, which is fixed in a recess in the support plate 7 provided for this purpose.

The guide neck 113 is accommodated in a hole in the support plate 7.

Furthermore, an annular stop 114 is provided between the wheel 111 and the foot 112, which, as shown in FIG. 7, represents an additional horizontal guide for a catch element 82 of a self-closing device 8, which is described in more detail below.

As shown in FIGS. 6 and 7, a self-closing device 8 is attached to each of the ends 53, 54 of the guide cam track 5 on the side facing the support plate 7 (open side of the guide groove 51 of the guide cam track 5).

The self-closing device 8 has a housing 81 with a guide track 83 and a catch element 82 that is spring-loaded and/or damped in the guide track 83 and catches the guide element 11 in a predetermined position.

Different relative positions of the guide element 11 relative to the self-closing device 8 are shown in FIGS. 10*a* to 10*d*.

The guide track 83 of the self-closing device 8 is preferably designed here as a so-called crutch curve, with a straight linear area 831 and an angled area 832 adjoining one end of the linear area 831.

Accordingly, the catch element 82 of the self-closing device 8 is essentially U-shaped with two legs 821, 822 projecting from the guide track 83 and two guide pins 823, 824, which are guided in the guide track 83.

FIG. 10*a* shows a position of the guide element 11 before running into an end position, in which the guide element 11 and the catch element 82 are still decoupled.

In FIG. 10*b*, the guide element 11 is in engagement with the catch element 82, which is still held by the second guide pin 824 in the angled area 832 of the guide track 83.

Figure 10D:
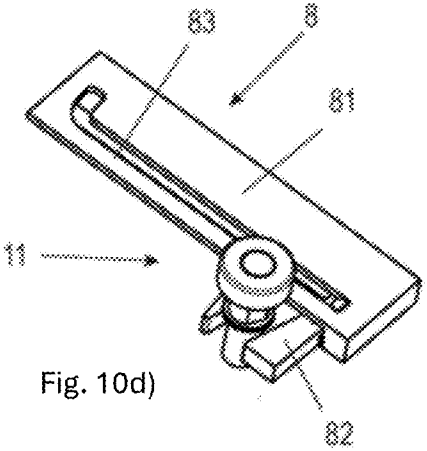
Figure 10C:
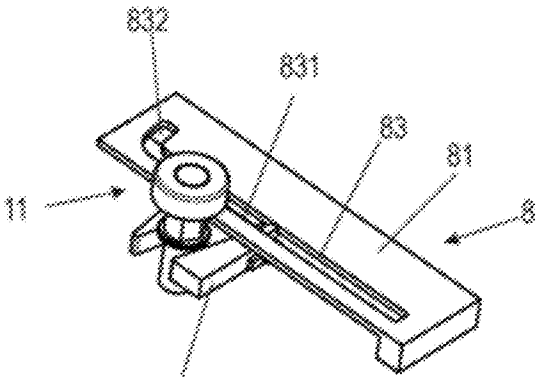

As the guide element 11 continues to move, the second guide pin 824 is pushed into the linear area 831 of the guide track 83 and then guided beyond the position shown in FIG. 10*c* to the end position shown in FIG. 10*d* by means of a spring element engaging the catch element 82, which is not shown here.

The end position shown in FIG. 10*d* corresponds to the position of the guide element in FIG. 7.

The self-closing device 8 is activated in the same way at the other end 54 of the guide cam track 5, which corresponds to the position shown in FIG. 3 in relation to the body part 3 moved by the guide fitting 4.

FIG. 11 shows an alternative design variant of a guide fitting 4.

In contrast to the embodiment shown in FIGS. 6-10, an arm 52 extending outside the guide groove 51 is arranged here on the guide cam track 5, from which two activators 10 extend, which engage in self-closing devices 8, which are fastened to respective edge areas 72 of the support plate 7.

As in the first embodiment described with reference to FIGS. 6 to 10, the support plate 7 has a central area 71, to which the two guide rails 61, which are aligned parallel to one another, are attached, and two edge areas 72 with self-closing devices 8.

The self-closing devices 8 are of the same design as the self-closing devices 8 described with reference to the first embodiment example with reference to FIGS. 6 to 10.

FIGS. 12 to 18 show a further alternative embodiment of such a guide fitting 4.

In contrast to the two embodiments shown in FIGS. 6 to 11, only one self-closing device 12 is provided in this embodiment, which, as shown in FIGS. 12 to 16, is arranged on an edge area 72 of the support plate 7.

Alternatively, the self-closing device 12 can also be arranged in a central area 71 of the support plate 7, for example between the linear guides 6, as shown by way of example in FIGS. 17 and 18.

In this embodiment, the self-closing device 12 is coupled to the running rail 62 of the at least one linear guide 6. In another embodiment of the linear guide 6, the self-closing device 8, 12 could, for example, be coupled to a roller carriage.

As shown in FIGS. 12 to 16, the self-closing device 12 has a toggle lever pivotably mounted on the support plate 7 with a first lever 121 pivotably attached to the running rail 62, preferably in the form of a pendulum lever, and a second lever 122 pivotably coupled to the first lever 121 and pivotably attached to the support plate 7 via a pivot bearing 125, preferably in the form of a power lever. The self-closing device 12 is coupled during the entire movement via a connecting piece 127 to the running rail 62 as the movable connecting part of the linear guide 6. The levers 121, 122 are arranged in such a way that closing support is provided at least in the area of the end positions.

In the embodiment shown in FIGS. 17 and 18, in which the self-closing device 12 is arranged between the linear guides 6, in contrast to the embodiment shown in FIGS. 12 to 16, the second lever 122 is pivotably attached to the running rail 62 and the first lever 121 is pivotably coupled at one end to the second lever 122 and pivotably attached at its second end to the support plate 7 via a pivot bearing 125.

It is also conceivable to arrange the levers 121, 122 in such a way that closing forces act from a position of the linear guide 6 that corresponds to a rotational angle of preferably 45°. The closing forces caused by the self-closing device 12 increase with further movement into the end position. Design variants are also conceivable in which the self-closing device 12 engages at even smaller angles of rotation.

Furthermore, a force accumulator 123 is held on the support plate 7, which is arranged on the second lever 122 or the first lever 121.

The coupling of the self-closing device 12 via the linear guide 6 and thus via the translational movement of the body part 3 also enables secure retraction into a respective end position of the body part 3, analogous to the embodiment variant shown in FIGS. 6 to 11, in which the self-closing device 8 is coupled via the guide cam track 5 and thus via the rotational movement of the body part 3.

Furthermore, as shown in FIGS. 12 to 18, a damping element 124 is additionally arranged between the support plate 7 and the first lever 121 or the second lever 122, with which the run-in into the end position can be damped. In this embodiment example, the force accumulator 123 and the damping element 124 are fixed to the support plate 7 via a mounting bearing 126.

It is also conceivable to supplement the self-closing device 8, 12 with at least one ejection device.

While FIGS. 12 and 13 show the positioning of the self-closing device 12 in an end position, FIGS. 15, 17 and 18 show the guide fitting in an intermediate position, corresponding approximately to the position of the body part 3 relative to the support body 2 shown in FIG. 2.

FIG. 16 shows the end position of the self-closing device 12, which has moved into the second position, corresponding to the position of the body part 3 relative to the support body 2 shown in FIG. 3.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE SIGNS

1 Furniture or household appliance element
2 Support body
21 Base support plate
22 Top support plate
23 Side wall
3 Body part
31 Base plate
32 Top plate
33 Side wall
35 Shelf
36 Corner post
4 Guide fitting
5 Guide cam track
51 Guide groove
52 Arm
53 End
54 End
6 Linear guide
61 Guide rail
62 Running rail
7 Support plate
71 Central area
72 Edge area
73 Fixing element
74 Fixing element
8 Self-closing device
81 Housing
82 Catch element
821 First leg
822 Second leg
823 First guide pin
824 Second guide pin
83 Guide track
831 Linear area

832 Angled area
9 Pivot bearing
91 Mounting plate
92 Turntable
93 Mounting Plate
10 Activator
11 Guide element
111 Wheel
112 Foot
113 Guide neck
114 Stop
12 Self-closing device
121 First lever
122 Second lever
123 Force accumulator
124 Damping element
125 Pivot bearing
126 Mounting bearing
127 Connecting piece
A Direction of translation
R1, R2 Direction of rotation

The invention claimed is:

1. A guide fitting configured to guide movement of a body part mounted relative to a stationary base in simultaneous translational and rotational movement, the guide fitting comprising:
- a guide cam track;
- a guide element configured to be guided in the guide cam track;
- a linear guide with at least one first connecting part and a second connecting part, wherein the second connecting part is movable relative to the first connecting part, wherein one of the first and second connecting parts is coupled in a stationary manner to the guide element and the other one of the first and second connecting parts is coupled to the guide cam track by a pivot bearing; and
- at least one self-closing device coupled at least in sections to the linear guide or to the guide cam track,
- wherein the guide cam track or the guide element is configured to be fixedly attached to the body part,
- wherein the guide cam track is movable relative to the first connecting part from an initial position into an intermediate position and further into an opening position and back to the initial position, and
- wherein, in an intermediate position, the guide cam track is rotated relative to the first connecting part in a direction of rotation and displaced in a predetermined direction.

2. The guide fitting of claim 1, wherein the guide cam track has a guide groove configured to receive the guide element.

3. The guide fitting of claim 1, further comprising:
- a support plate to which the first connecting part of the linear guide and the guide element are fixed.

4. The guide fitting of claim 1, wherein the at least one self-closing device is arranged in a fixed position relative to the guide cam track or relative to one of the first and second connecting parts of the linear guide.

5. The guide fitting of claim 1, wherein the at least one self-closing device has a housing with a guide track and a catch element, wherein the catch element is guided in the guide track in a spring-loaded or damped manner and catches the guide element in a predetermined position.

6. The guide fitting of claim 5, wherein the at least one self-closing device comprises first and second self-closing devices arranged at mutually spaced ends of the guide cam track.

7. The guide fitting of claim 3, wherein
- the support plate has a central area, to which the first connecting part of the at least one linear guide is fastened,
- the support plate has two edge areas of mirror-symmetrical shape,
- the at least one self-closing device comprises first and second self-closing devices,
- the first and second self-closing devices are respectively arranged on one of the two edge areas, and
- the guide cam track has an arm extending outside the guide groove and on which first and second activators, respectively interacting with the first and second self-closing device, are arranged.

8. The guide fitting of claim 1, wherein the at least one self-closing device is coupled to the second connecting part of the at least one linear guide.

9. The guide fitting of claim 8, wherein the at least one self-closing device comprises:
- a toggle lever pivotably mounted on the support plate, wherein the toggle lever includes
  - a first lever pivotably fastened to the second connecting part, and
  - a second lever pivotably coupled to the first lever, pivotably fastened to the support plate or the stationary base; and
- at least one force accumulator coupled to the first lever or the second lever.

10. The guide fitting of claim 8, wherein the self-closing device comprises:
- a toggle lever pivotably mounted on the support plate, wherein the toggle lever includes
  - a second lever pivotably fastened to the second connecting part,
  - a first lever pivotably coupled to the second lever and pivotably fastened to the support plate or the stationary base; and
- at least one force accumulator coupled to the first lever or the second lever.

11. The guide fitting of claim 9, wherein the force accumulator is held directly or indirectly on
- the support plate, or
- the second connecting part of the at least one linear guide.

12. The guide fitting of claim 9, further comprising:
- at least one damping element arranged between the support plate and the first lever or arranged between the support plate and the second lever.

13. The guide fitting of claim 1, further comprising:
- at least one ejection device.

14. The guide fitting of claim 1, wherein the linear guide consists of two guide rails aligned parallel to one another and running rails displaceable relative to the two guide rails.

15. A furniture or household appliance element comprising:
- a stationary support body;
- a body part with at least one shelf surface, wherein the body part is mounted so as to be movable in translation and rotation relative to the support body;
- at least one guide fitting configured to allow a translational-rotational movement of the body part relative to a support plate of the support body from an initial position into an intermediate position and further into an opening position and back to the initial position,
- wherein, in an intermediate position, the body part is rotated relative to the support plate in a direction of rotation and displaced in a predetermined direction of translation, wherein the at least one guide fitting has at least one guide cam track and a guide element guided in the guide cam track, wherein the at least one guide cam track and the guide element are arranged on mutually facing surfaces of the body part and the support plate, wherein the at least one guide fitting further comprises at least one linear guide, wherein the at least one linear guide includes a first connecting part, wherein the at least one linear guide includes a second connecting part movable relative the first connecting part, wherein one of the first and second connecting parts is coupled in a stationary manner to the guide element and the other one of the first and second connecting parts is coupled to the guide cam track by a pivot bearing, wherein the at least one guide fitting further comprises at least one self-closing device coupled at least in sections to the linear guide or to the guide cam track and arranged between the body part and the support plate.

16. The furniture or household appliance element of claim 15, wherein the guide cam track is fixed to a base plate of the body part or is fixed to a top plate of the body part, wherein the support plate of the support body comprises a base support plate and a top support plate, and wherein the guide element is fixed to the base support plate or is fixed to the top support plate of the support body.

17. The furniture or household appliance element of claim 16, further comprising:

a first guide fitting arranged between the base support plate and the base plate; and a second guide fitting arranged between the top support plate and the top plate.

18. The furniture or household appliance element of claim 16, wherein the body part is movable relative to the support body from a first functional position into a second functional position rotated by a predetermined angle relative to the initial position, wherein the base and top plates of the body part and the top and base support plates of the support body are aligned in matching geometries relative to one another in both the first and second functional positions.

* * * * *